US005636534A

United States Patent [19]

Bertoldo

[11] Patent Number: 5,636,534

[45] Date of Patent: Jun. 10, 1997

[54] APPARATUS FOR THE WET SURFACE TREATMENT OF CONTINUOUS TEXTILE MATERIALS

[75] Inventor: Franco Bertoldo, Brogliano, Italy

[73] Assignee: Sperotto Rimar S.p.A., Milan, Italy

[21] Appl. No.: 379,158

[22] Filed: Jan. 27, 1995

[30] Foreign Application Priority Data

Jan. 27, 1994 [IT] Italy ..... MI94A0132

[51] Int. Cl.[6] ..... D06B 3/20

[52] U.S. Cl. ..... 68/175; 68/184; 26/28

[58] Field of Search ..... 68/175, 176, 147, 68/158, 184, 50; 26/27, 28, 19, 29; 28/163, 165, 167; 8/151

[56] References Cited

U.S. PATENT DOCUMENTS

| | | | |
|---|---|---|---|
| 2,342,266 | 2/1944 | Gessner | 68/175 |
| 3,019,630 | 2/1962 | Fleissner et al. | 68/158 |
| 3,037,370 | 6/1962 | Rezzonico | 68/158 |
| 3,469,932 | 9/1969 | Feissner | 68/158 |
| 4,070,875 | 1/1978 | Kutz | 68/175 |
| 4,158,297 | 6/1979 | Winch | 68/184 |
| 4,173,452 | 11/1979 | Fleissner | 68/158 |
| 4,393,532 | 7/1983 | Sando et al. | 68/5 D |
| 4,672,705 | 6/1987 | Bors et al. | 8/151 |
| 4,845,964 | 7/1989 | Bors et al. | 68/202 |
| 4,947,501 | 8/1990 | Koch | 8/151 |
| 5,005,270 | 4/1991 | Childers | 68/175 |
| 5,109,630 | 5/1992 | Love et al. | 26/28 |
| 5,203,043 | 4/1993 | Riedel | 8/151 |
| 5,218,747 | 6/1993 | Riedel | 26/28 |
| 5,459,911 | 10/1995 | Iwami | 26/28 |

FOREIGN PATENT DOCUMENTS

| | | | |
|---|---|---|---|
| 243457 | 7/1960 | Australia | 68/175 |
| 1075542 | 2/1960 | Germany | 68/175 |
| 2532459 | 2/1977 | Germany | 26/28 |
| 47-23720 | 7/1972 | Japan | 68/158 |
| 60-151364 | 8/1985 | Japan | 68/158 |

*Primary Examiner*—Frankie L. Stinson

*Attorney, Agent, or Firm*—Cushman Darby & Cushman, IP Group Of Pillsbury Madison Sutro, L.L.P.

[57] ABSTRACT

An apparatus for the wet surface treatment (i.e., sueding) of continuous textile materials, including an outer casing provided with an entry region and an exit region, a wet treatment unit containing treatment water and into which a continuous textile material to be treated is passed and at least one rotating fluffing (i.e., sueding) roller against which the continuous textile material is made to slide, the at least one fluffing roller being at least partly immersed in the treatment water contained in the wet treatment unit.

7 Claims, 3 Drawing Sheets

13
26
24
19
27
18
29
30
17
28
23
25
45
14
12
21
22
11

APPARATUS FOR THE WET SURFACE TREATMENT OF CONTINUOUS TEXTILE MATERIALS

BACKGROUND OF THE INVENTION

This invention relates to an apparatus for the wet surface treatment (i.e., sueding) of continuous textile materials.

Apparatus for the surface treatment of dry fabrics are currently known incorporating one or more rotating rollers covered with a conventional abrasive band.

These known apparatus, usually known as fluffing (or sueding) machines, provide the treated fabrics with tactile and visual effects deriving from the partial removal of fibrous material from their surface, to hence give them a more or less accentuated surface pile.

There is an increasing requirement for achieving new and different tactile and visual effects. For example, tactile effects are required such as to soften the fabric while at the same time preventing the formation of surface pile. Other required visual effects include those which determine a fabric appearance similar to discolouring and/or ageing, as possessed by used fabrics.

SUMMARY OF THE INVENTION

The object of the present invention is to provide an apparatus able to satisfy the aforesaid requirements by means of new mechanical and technological characteristics.

This object is attained according to the present invention by an apparatus for the wet surface treatment of continuous textile materials, comprising an outer casing provided with a entry region and an exit region, a wet treatment unit containing treatment water and into which a continuous textile material to be treated is passed, and at least one rotating fluffing roller against which said continuous textile material is made to slide, characterised in that said at least one fluffing roller is at least partly immersed in said treatment water contained in said wet treatment unit.

BRIEF DESCRIPTION OF THE DRAWING

The characteristics and advantages of an apparatus for the wet surface treatment of continuous textile materials according to the present invention will be more apparent from the description given hereinafter by way of non-limiting example, with reference to the accompanying schematic drawings, in which.

DETAILED DESCRIPTION

Figure 1:
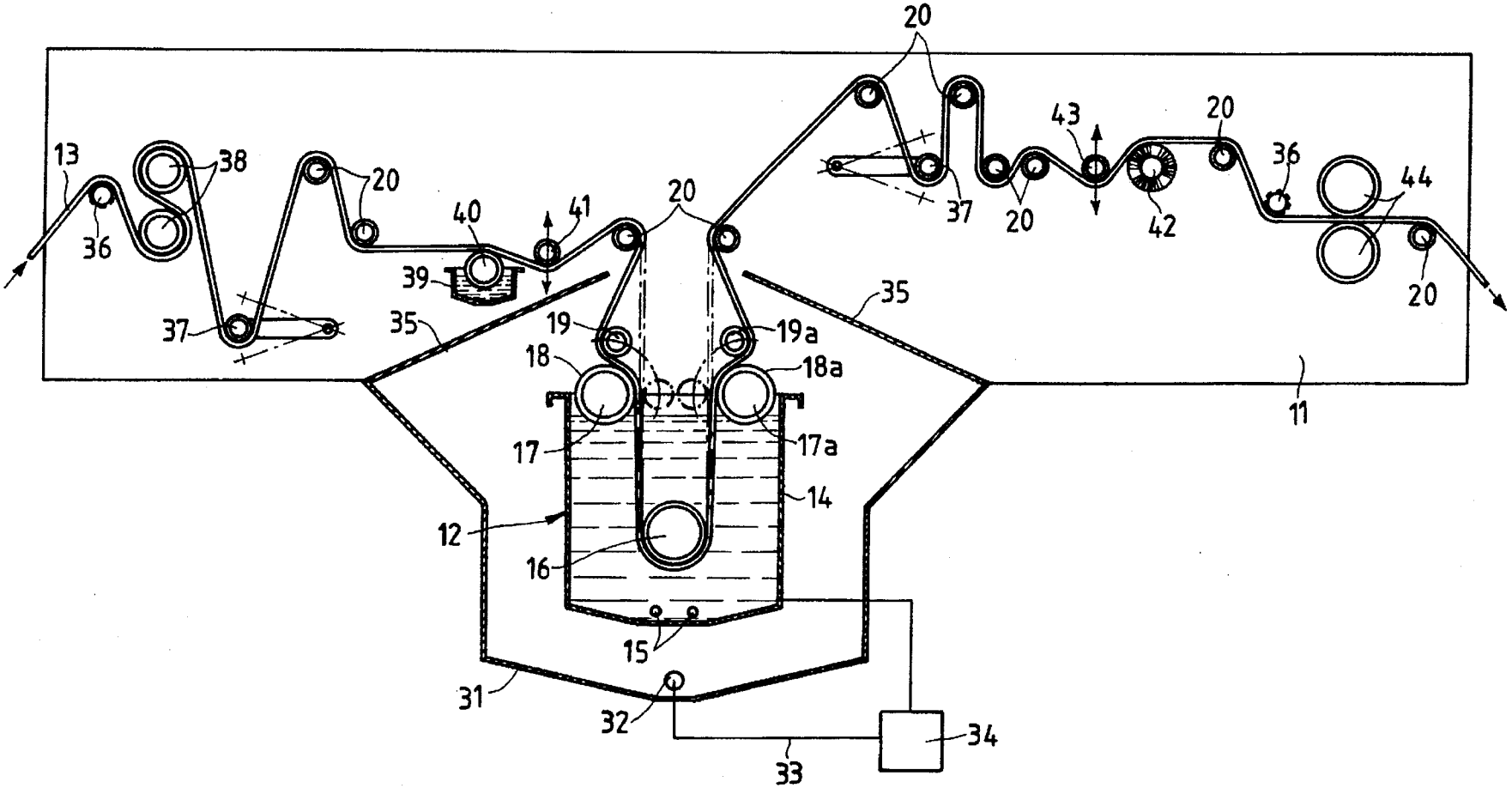
FIG. 1 is a schematic elevation of an apparatus for the wet treatment of continuous textile materials according to the present invention.
Figure 2:
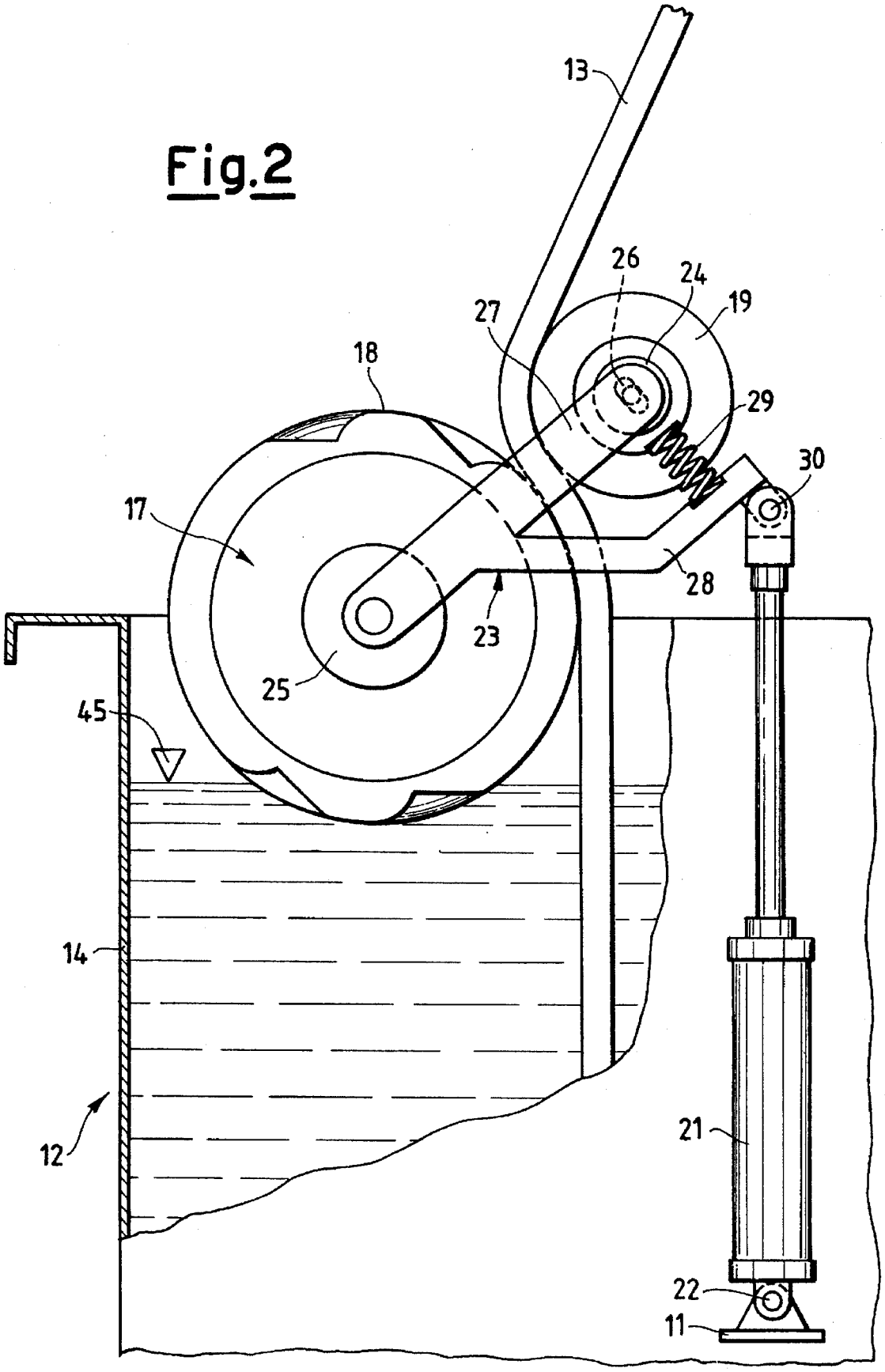
FIG. 2 is an enlarged view of a central part of the apparatus of FIG. 1 showing a portion of the inner tank and a fluffing roller acting on the textile material which partly embraces it.

FIG. 1 shows by way of example a general embodiment of an apparatus for the wet surface treatment (i.e., sueding) of continuous textile materials in accordance with the present invention.

The apparatus consists essentially of an outer casing 11 comprising a wet treatment unit, indicated overall by 12, for a continuous textile material, such as a fabric 13, which is fed upstream to the apparatus entry.

The wet treatment unit 12 comprises an inner first tank 14 containing treatment water, to which chemical products may be added to facilitate treatment of the fabric 13. The inner tank 14 is provided with water heating elements 15, with at least one motorized roller 16 which participates in the conveying of the fabric 13 and is totally immersed in the water, and with at least one fluffing (i.e., sueding) roller 17, which is at least partially immersed in the water. In the illustrated example, two fluffing rollers are provided arranged on opposite sides of the motorized roller 16.

The fluffing roller 17 can rotate both clockwise and anticlockwise, its outer surface 18 consisting of or being coverable with abrasive material, such as diamond-clad and/or in any event water-resistant material. The outer surface 18 preferably consists of a plurality of variously arranged geometrical forms or surface portions of any desired kind, which act on the fabric. In the illustrated apparatus embodiment, it can be seen that there are two rollers 17 and **17*a* acting on the fabric 13, the first 17 before it reaches the motorized roller 16 and the other 17*a* after the fabric has passed beyond the roller 16. The action of each of the fluffing rollers 17 and 17*a* on the fabric 13 develops by virtue of the presence of a respective penetrator roller 19 and 19*a* which determines whether the fabric makes contact or does not make contact with the outer surface and 18*a* of the respective fluffing roller 17 and 17*a*. Suitable idle deviation rollers 20, positioned rotatable on the outer casing 11, cooperate in achieving this contact by the fabric. As shown in FIG. 1, the penetrator rollers 19 and 19*a* can be moved between a passive position, indicated by dashed and dotted lines, and a series of active positions selectable at will. This movement determines selectable wrapping of the fabric about the outer surface 18 and 18*a* of the respective fluffing roller 17 and 17*a*, and can be different for the two rollers 19 and 19*a*. For this purpose, for each of the two penetrator rollers 19 and 19*a* there is provided a suitable pair of cylinders 21, only one of which is shown, connected to the outer casing 11 by pins 22. The two pairs of cylinders 21 act via a shaped lever, indicated overall by 23, on the ends of a shaft 24 supporting the rollers 19 and 19*a*, in order to move them about hubs 25 of the rollers 17 and 17*a***.

According to the present invention, there is also provided a device for compensating any general tension differences within the fabric or rather between the two selvedges of the fabric 13.

In this device, each end of the shaft 24, acting as a hub, is housed within a slot 28 provided in a first arm 27 of the lever 23. Between the hub 24 and a second arm 28 of the lever 23 there is provided an elastic element 29, such as a load cell or spring, acting as a damper of electronic or mechanical type. It should be noted that the cylinder 21 is rotatable about the arm 28 of the lever 23 via a pin 30 which enables it to adapt to the variation in inclination.

If transverse tension differences exist in the fabric 13, for example due to different tensions of the two selvedges or between one of the selvedges and an intermediate portion of the fabric 13, the elastic element 29 compresses as it is subjected to a greater thrust force determined by the tauter selvedge. Simultaneously, by virtue of the arrangement of the invention, the elastic element 29 provided at the other end of the penetrator roller 19 or **19*a* undergoes corresponding release. This is because this second elastic element is subjected to a lesser thrust determined by the other less taut selvedge. The axis of the roller 19 or 19*a* undergoes adequate inclination to the surface of the fabric 13 by virtue of the opposing movement of the two hubs 24 within the respective slots 26. In this manner, treatment uniformity in the transverse direction of the fabric 13** is achieved.

About the wet treatment unit 12 there is also provided an outer second tank 31 for collecting fibrous textile material worn off the textile material 13 together with the water which entrains it. The outer tank 31 comprises a bottom discharge 32 connected by an external circuit 33 to a filter and pump, shown schematically at 34, which remove solid impurities and recycle the water to the inner tank 14.

Above the outer tank 31 there are positioned deflector elements 35 which retain the fibrous textile material worn off the fabric 13 and its entrainment water propelled by the fluffing rollers 17 and 17*a*, both when rotating in a clockwise and an anticlockwise direction.

The apparatus in the embodiment illustrated by way of example can also comprise a series of further idle deviation rollers 20 for determining the path of the fabric 13.

At the entry to the apparatus there is provided a widening slat roller 36, automatic longitudinal tension control elements shown schematically at 37 and motorized rollers 38 for conveying the fabric 13. Elements can also be provided for applying water to the advancing fabric, such as a device of the plating type for applying water possibly with added auxiliary chemical products which facilitate the subsequent treatment. These elements can comprise a tank 39 containing a rotary spreading roller 40, and an associated movable roller 41 causing the textile material to lower into contact or to rise out of contact with the rotary roller 40. At the exit of the wet treatment unit 12 there are provided further elements for automatically controlling the longitudinal tension, such as those indicated heretofore by 37.

Further idle deviation rollers 20 conduct the fabric 13 towards a rotating brush 42 with which there is associated at least one upwardly and downwardly movable roller 43 for determining its activation.

The fabric 13 then reaches a widening slat roller, such as that indicated heretofore by 36, after which it passes between two motorized squeezing rollers 44 for water removal and for conveying the fabric 13 towards the exit of the apparatus according to the present invention.

It is apparent that the water level within the inner tank 14 is controlled and regulated by a suitable sensor indicated schematically at 45, connected to an independent make-up water supply, not shown.

Figure 3:
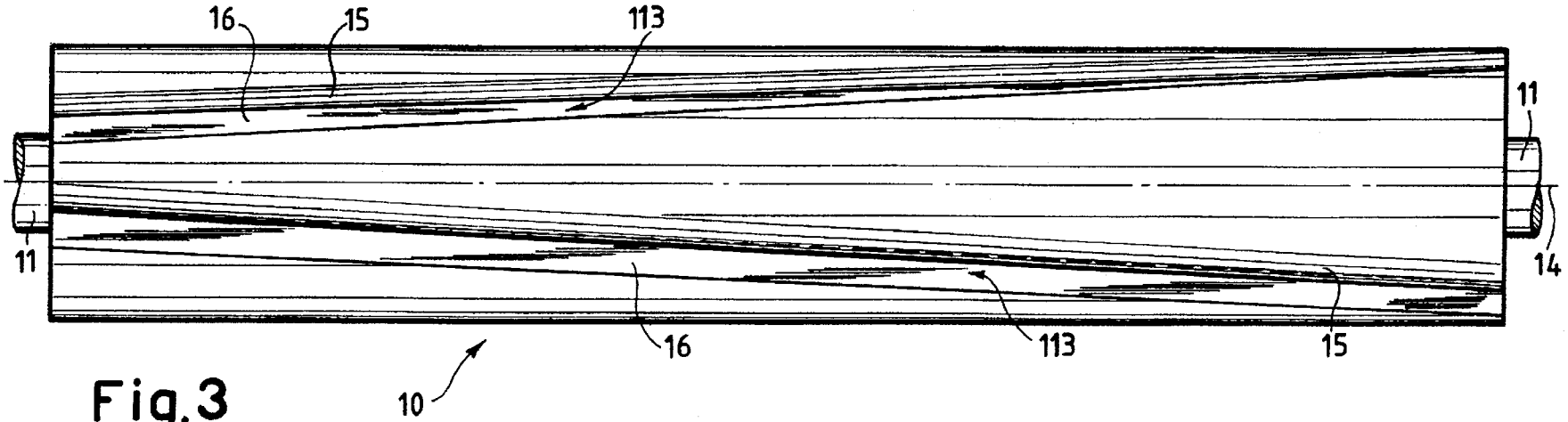
FIG. 3 is an enlarged frontal view of one embodiment of a fluffing roller taken in the direction of the arrow F of FIG. 4.
Figure 4:
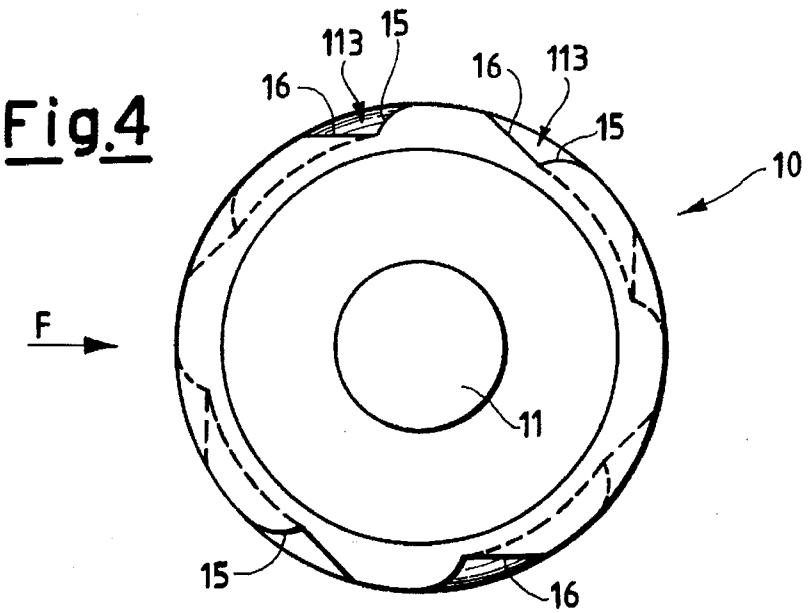
FIG. 4 is a transverse end view of the roller of FIG. 3.

FIGS. 3 and 4 show a possible embodiment of a fluffing roller in which the geometrical forms are defined by milling the outer lateral surface 18 or 18*a* of the fluffing roller or cylinder 17 or 17*a*.

This milling forms recesses, indicated overall by 50, which are shaped as a triangle with a first side 51 straight and a second side 52 rounded. The third side is represented by the missing lateral surface portion.

Specifically, FIGS. 3 and 4 show that in the lateral surface of the cylinder 17 or 17*a* applied to the invention there are provided four recesses 50. Any two successive recesses 50 wind in mutually reverse directions so as to exert in succession on the fabric an essentially transverse widening action firstly in one direction and then in the other direction.

Advantageously in a surface treatment apparatus twisted portions winding in one direction and twisted portions winding in the opposite direction or differently winding recessed portions can be provided in the surface of one and the same cylinder or in part of the surface of a cylinder.

As stated, such an arrangement comprising one or more rollers or cylinders not only exerts the action deriving from them but also provides a fabric widening action.

It should further be noted that the presence of recesses 50 results in a true mechanical action on the fabric. This action can be identified as actual beating of the fabric.

I claim:

1. An apparatus for the wet surface treatment of continuous textile materials, comprising:

an outer casing provided with an entry region and an exit region;

a wet treatment unit containing treatment water and into which a continuous textile material to be treated is passed; at least one rotating fluffing roller against which said continuous textile material is made to slide;

said at least one fluffing roller being at least partly immersed in said treatment water contained in said wet treatment unit;

a respective penetrator roller associated with each said fluffing roller for determining whether said textile material makes contact or does not make contact with the outer surface of said at least one fluffing roller;

tension compensation elements for said continuous textile material being associated with said penetrator roller for automatically and continuously compensating any tension differences between the selvedges of said textile material or between a selvedge and an intermediate portion of said continuous textile material.

2. An apparatus as claimed in claim 1, wherein:

said compensation elements are damper devices of mechanical type.

3. An apparatus as claimed in claim 1, wherein:

said compensation elements are damper devices of electronic type.

4. An apparatus as claimed in claim 1, said at least one penetrator roller is controlled by at least one cylinder pivoted to said casing and to the respective said penetrator roller.

5. An apparatus as claimed in claim 1, wherein:

said at least one fluffing roller has an outer surface consisting of a plurality of millings having a straight side and a rounded side.

6. An apparatus for the wet surface treatment of continuous textile materials, comprising:

an outer casing provided with an entry region and an exit region;

a wet treatment unit containing treatment water and into which a continuous textile material to be treated is passed; at least one rotating fluffing roller against which said continuous textile material is made to slide;

said at least one fluffing roller being at least partly immersed in said treatment water contained in said wet treatment unit;

said wet treatment unit comprising at least one motorized roller which cooperates in conveying of said textile material and is totally immersed in the water, and a pair of said fluffing rollers, which are at least partly immersed in the water and are positioned on opposite sides about said motorized roller.

7. An apparatus as claimed in claim 6, wherein:

said at least one fluffing roller has an outer surface consisting of a plurality of millings having a straight side and a rounded side.

* * * * *